US008536973B2

(12) United States Patent
Lo et al.

(10) Patent No.: US 8,536,973 B2
(45) **Date of Patent: *Sep. 17, 2013**

(54) OVER-CURRENT PROTECTION DEVICE

(75) Inventors: Kuo Chang Lo, New Taipei (TW); Yao Te Chang, Linnei Township, Yunlin County (TW); Ya Fang Liang, Taichung (TW); Yi An Sha, Xindian (TW); David Shau Chew Wang, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/531,979

(22) Filed: Jun. 25, 2012

(65) Prior Publication Data

US 2013/0200988 A1 Aug. 8, 2013

(30) Foreign Application Priority Data

Feb. 7, 2012 (TW) ..... 101103836 A

(51) Int. Cl.
*H01C 7/10* (2006.01)

(52) U.S. Cl.
USPC ..... 338/22 R

(58) Field of Classification Search
USPC ..... 338/22 R
See application file for complete search history.

(56) References Cited

U.S. PATENT DOCUMENTS

| | | | | |
|---|---|---|---|---|
| 5,961,888 | A * | 10/1999 | Geissinger et al. | 252/511 |
| 6,143,206 | A * | 11/2000 | Handa et al. | 252/500 |
| 7,001,538 | B2 * | 2/2006 | Lee et al. | 252/511 |
| 7,182,801 | B2 * | 2/2007 | Kim et al. | 75/255 |
| 7,382,224 | B2 * | 6/2008 | Wang et al. | 338/22 R |
| 8,169,294 | B2 * | 5/2012 | Sha et al. | 338/22 R |

* cited by examiner

*Primary Examiner* — Kyung Lee
(74) *Attorney, Agent, or Firm* — Egbert Law Offices, PLLC

(57) ABSTRACT

An over-current protection device includes two metal foils and a PTC material layer. The PTC material layer is laminated between the two metal foils and has a resistivity less than 0.4 Ω-cm. The PTC material layer includes crystalline polymer and electrically conductive ceramic filler dispersed in the crystalline polymer. The conductive ceramic filler is of HCP structure and includes 70-95% by weight of the PTC material layer. The trip jump value of the over-current protection device after 300 times trip is less than or equal to 25. The resistance repeatability of the device can be effectively improved by adding the conductive ceramic filler.

18 Claims, 1 Drawing Sheet

OVER-CURRENT PROTECTION DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to a thermistor, and more particularly to an over-current protection device.

2. Description of Related Art Including Information Disclosed Under 37 CFR 1.97 and 37 CFR 1.98

Because the resistance of conductive composite materials having a positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance instantaneously increases to a high resistance state (e.g., at least $10^2\Omega$), so as to suppress over-current and protect the cell or the circuit device.

PTC conductive composite material may include one or more crystalline polymers and conductive filler. The conductive filler is evenly distributed in the crystalline polymer. The polymer may be usually polyolefin such as polyethylene, while the conductive filler may be carbon black, conductive ceramic and metallic powder.

The conductive ceramic filler stacks to form conductive paths. Whenever over-current or over-temperature occurs, the stack changes and the number of the conductive paths decreases because the crystalline polymer of the composite material will be heated and then cooled to be re-crystallized. As a result, the resistance is difficult to return to its initial resistance value, i.e., the trip jump is high, when the conductive composite material undergoes repetitive over-current or over-temperature events.

BRIEF SUMMARY OF THE INVENTION

To increase battery lifetimes, the over-current protection devices used for secondary batteries have to perform good resistance recovery after trips. In accordance with the present application, an over-current protection device having crystalline polymer and conductive ceramic filler with specific structure exhibits very low initial resistance value and superior resistance repeatability.

To effectively decrease the resistance value of the over-current protection device after trip and sustain the resistivity of the conductive composite material less than 0.4 Ω-cm, conductive ceramic filler with specific stack structure is used. The conductive ceramic filler is of hexagon close-packed (HCP) structure which can form more conductive paths, thereby improving electrical conductivity and resistance repeatability.

In accordance with an embodiment of the present application, an over-current protection device, i.e., a PTC chip, includes two metal foils and a PTC material layer. The PTC material layer is laminated between the two metal foils and has a resistivity less than 0.4 Ω-cm. The PTC material layer includes crystalline polymer and conductive ceramic filler dispersed in the crystalline polymer. The conductive ceramic filler has atoms of HCP lattice, and includes 70%-95% by weight of the PTC material layer.

In an embodiment, the conductive ceramic filler may include powders with grain sizes between 0.01 μm and 100 μm, or preferably between 0.1 μm and 50 μm. The conductive ceramic filler may be molybdenum carbide, tungsten carbide or the mixture thereof.

In an embodiment, PTC material layer may use crystalline polyolefines (e.g., high-density polyethylene (HDPE), medium-density polyethylene, low-density polyethylene (LDPE), polyvinyl wax, vinyl polymer, polypropylene, polyvinyl chlorine and polyvinyl fluoride), copolymer of olefin monomer and acrylic monomer (e.g., copolymer of ethylene and acrylic acid or copolymer of ethylene and acrylic resin) or copolymer of olefin monomer and vinyl alcohol monomer (e.g., copolymer of ethylene and vinyl alcohol), and may include one or more crystalline polymer materials. The LDPE can be polymerized using Ziegler-Natta catalyst, Metallocene catalyst or the like, or can be copolymerized by vinyl monomer and other monomers such as butane, hexane, octane, acrylic acid, or vinyl acetate.

By using the conductive ceramic filler of HCP structure, a trip jump value (R300/Ri) of the PTC material layer is less than or equal to 25, where Ri is an initial resistance value and R300 indicates a resistance value which is measured one hour later after the device is tripped 300 times and returns to room temperature.

Because the PTC material layer has extremely low resistivity, the area of the PTC chip (i.e., the area of the PTC material layer) can be reduced to less than 50 $mm^2$ and such PTC chip still has low resistivity. Accordingly, more PTC chips can be manufactured from a single PTC material sheet of same area and thereby the cost can be significantly reduced.

In an embodiment, two metal electrode leads may be jointed to the two metal foils of the over-current protection device by reflow or spot-welding process to form an assembly of, for example, axial-leaded, radial-leaded, terminal or surface mounted device. In another embodiment, the two metal foils of the over-current protection device can be connected to power to form a circuit, and the PTC material layer will trip to protect the circuit when over-current occurs.

BRIEF DESCRIPTION OF THE SEVERAL VIEWS OF THE DRAWINGS

The present application will be described according to the appended drawings in which.

DETAILED DESCRIPTION OF THE INVENTION

Figure 1:
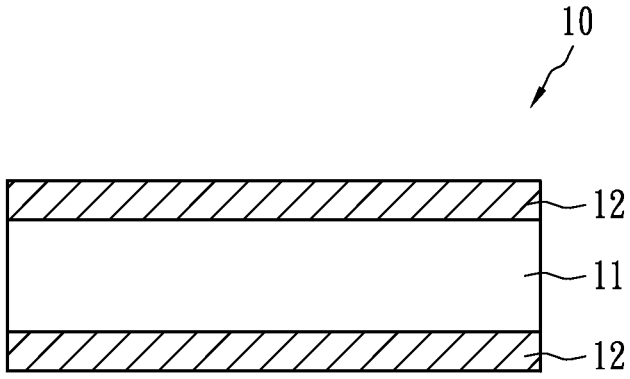
FIG. 1 shows an over-current protection device in accordance with an embodiment of the present application.

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

The composition of the over-current protection device in accordance with embodiments Em. 1-14, comparative examples Comp. 1-4, and related manufacturing process are stated below.

The composition and weight (unit: gram) of PTC material layer of the over-current protection device of the present application are shown in Table 1. LDPE-1 is low-density crystalline polyethylene of a density 0.924 g/cm$^3$ and a melting point 113° C. HDPE-1 is high-density crystalline polyethylene of a density 0.943 g/cm$^3$ and a melting point 125° C. HDPE-2 is high density crystalline polyethylene of a density 0.961 g/cm$^3$ and a melting point 131° C. In Em. 1-14, the conductive ceramic filler may include molybdenum carbide ($Mo_2C$), tungsten carbide (WC) or the mixture thereof. The conductive ceramic filler may further add magnetic material such as iron (Fe), cobalt (Co), nickel (Ni) vanadium (V) or the mixture thereof. Moreover, inorganic filler such as metal oxide, metal hydroxide or metal nitride may be used if needed. In an embodiment, magnesium hydroxide ($Mg(OH)_2$) is used. Conductive ceramic carbide may be of debris, polygonal, spheral or flake shape. Comp. 1-4 use zirconium carbide (ZrC) or titanium carbide (TiC) those are of face-centered cubic (FCC) lattice. The conductive ceramic filler is adapted to obtain better combination and stack for crystalline polymer and conductive ceramic filler, so as to resolve less conductive path problem caused by rearrangement of the conductive ceramic filler whenever the crystalline polymer heats up and then cools down to induce re-crystallization. The addition of the magnetic material can be further added to strengthen the aforementioned effects. However, the addition of the magnetic material is optional for this application. In an embodiment, the conductive ceramic filler includes 70%-95% by weight of the PTC material layer, and may include 75%, 80%, 85%, 90% or 92% by weight of the PTC material layer. The magnetic material may include less than 15% by weight of the PTC material layer, and may include less than 10% or 8% in particular by weight of the PTC material layer.

In an embodiment, the manufacturing process of the thermistor is described as follows. The raw material is fed into a blender (HAAKE 600) at 160° C. for two minutes. The procedure of feeding the raw material includes adding the crystalline polymers with the amounts according to Table 1 into the blender; after blending for a few seconds, then adding the conductive ceramic filler with particle size distribution between 0.1 μm and 50 μm, magnetic material and flame retardant. The rotational speed of the blender is set at 40 rpm. After blending for three minutes, the rotational speed is increased to 70 rpm. After blending for 7 minutes, the mixture in the blender is drained and thereby a conductive composition with PTC characteristic is formed.

The above conductive composition is loaded symmetrically into a mold with outer steel plates and a 0.33 mm and 0.2 mm thick middle, wherein the top and the bottom of the mold are disposed with a Teflon cloth. The mold loaded with the conductive composition is pre-pressed for three minutes at 50 kg/cm$^2$, 180° C. Then the generated gas is exhausted and the mold is pressed for 3 minutes at 100 kg/cm$^2$, 180° C. Next, another press step is performed at 150 kg/cm$^2$ and 180° C. for three minutes to form a PTC material layer 11, as shown in FIG. 1. In an embodiment, the thickness of the PTC material layer 11 is greater than 0.1 mm, or preferably greater than 0.2 mm or 0.3 mm.

The PTC material layer 11 may be cut into many square pieces each with an area of 20×20 cm$^2$. Then two metal foils 12 are pressed to physically contact the top surface and the bottom surface of the PTC material layer 11, in which the two metal foils 12 are symmetrically placed upon the top surface and the bottom surface of the PTC material layer 11. Next, buffers, Teflon cloths and the steel plates are placed on the metal foils and are pressed to form a multi-layered structure. The multi-layer structure is pressed again at 180° C. and 70 kg/cm$^2$ for three minutes. Next, the multi-layered structure is punched or cut to form an over-current protection device 10 with an area of 2.8 mm×3.5 mm.

Figure 2:
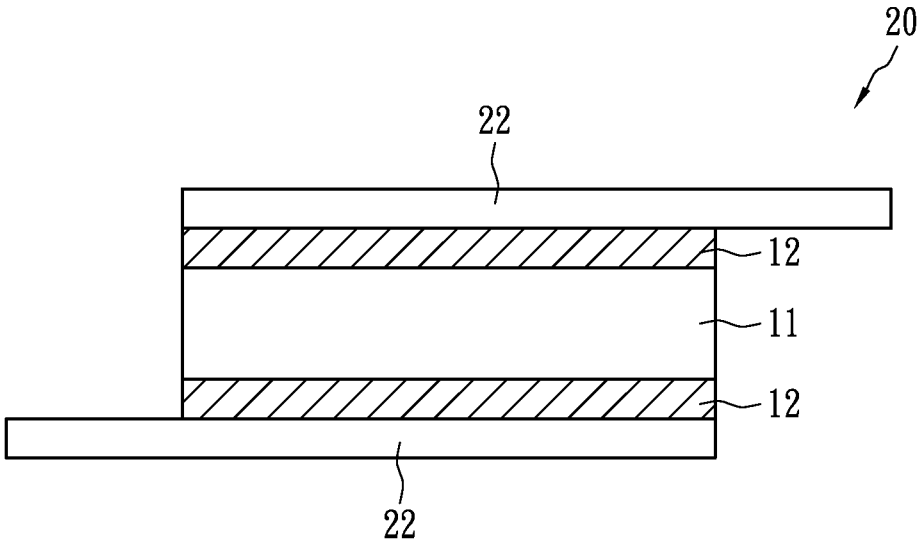
FIG. 2 shows an over-current protection device in accordance with another embodiment of the present application.

In an embodiment, two metal electrode leads 22 are jointed to the electrically conductive members 11 and 12 by solder reflow to form an axial-leaded over-current protection device 20, as shown in FIG. 2. In practice, devices of other types such as radial-leaded, terminal or surface mountable device can be made as desired.

TABLE 1

| | LDPE-1 | HDPE-1 | HDPE-2 | ZrC | $Mo_2C$ | TiC | WC | $Mg(OH)_2$ | Fe | Co | Ni | V |
|---|---|---|---|---|---|---|---|---|---|---|---|---|
| Em 1 | 4 | 14.1 | — | — | 197 | — | — | — | 6 | — | — | — |
| Em 2 | 9.3 | 11.4 | — | — | — | — | 285 | — | — | — | — | 5.6 |
| Em 3 | — | 21.6 | — | — | 210 | — | — | — | — | — | 20.8 | — |
| Em 4 | 25 | — | — | — | — | — | 315 | — | — | 9 | — | — |
| Em 5 | 1.2 | — | 16.7 | — | 200 | — | — | — | — | 18.7 | — | — |
| Em 6 | 8.6 | 11.3 | — | — | — | — | 260 | — | 7.9 | — | — | — |
| Em 7 | 1.4 | — | 20.7 | — | 205 | — | — | — | — | — | — | 17.6 |
| Em 8 | 13.5 | 8.6 | — | — | — | — | 308 | — | — | — | 12.9 | — |
| Em 9 | 3.7 | 18 | — | — | 98 | — | 125 | — | 4.3 | — | — | — |
| Em 10 | 2.9 | — | 17 | — | 128 | — | 106 | — | — | 10.6 | — | — |
| Em 11 | — | 8 | 14.8 | — | — | — | 253 | — | — | — | — | — |
| Em 12 | — | 15.7 | 14.3 | — | 105 | — | — | — | — | — | — | — |
| Em 13 | 5.3 | 28.3 | — | — | 94 | — | — | — | — | — | — | — |
| Em 14 | 16 | — | — | — | — | — | 377 | 4 | — | — | — | — |
| Comp 1 | 7 | 10.4 | — | — | — | 112 | — | — | — | — | — | — |
| Comp 2 | — | — | 19.2 | 146 | — | — | — | — | — | — | — | — |
| Comp 3 | — | 17.3 | — | 136 | — | — | — | — | 10.9 | — | — | — |
| Comp 4 | 3.6 | — | 14.8 | — | — | 105 | — | — | — | 12.6 | — | — |

Table 2 shows the test results of the over-current protection device. The volume resistivity ρ of the PTC material layer 11 can be obtained in light of formula (1):

$$\rho = \frac{R \times A}{L} \quad (1)$$

where R, A, and L indicate the resistance, the area, and the thickness of the PTC material layer 11, respectively. Substituting the initial resistance Ri of 0.0064Ω. (Refer to Em. 1 of Table 2 below), the area of 9.8 $mm^2$, and the thickness of 0.3 mm for R, A, and L in formula (1), respectively, a volume resistivity (ρ) of 0.0209 Ω-cm is obtained. Likewise, the resistivity values of other embodiments can be obtained as well, in which, for example, the resistivity ρ is equal to 0.016 Ω-cm for Em. 2. According to Table 2, the resistivity of the PTC material layer of the present application is less than 0.4 Ω-cm or less than 0.3 Ω-cm, 0.1 Ω-cm, 0.08 Ω-cm or 0.05 Ω-cm in particular.

TABLE 2

| | Area | Thickness | Ri | ρ | Resistance @ Trip state (mΩ) | | | R100/ | R300/ |
|---|---|---|---|---|---|---|---|---|---|
| | ($mm^2$) | (mm) | (mΩ) | (Ω-cm) | R10 | R100 | R300 | Ri | Ri |
| Em 1 | 9.8 | 0.3 | 6.4 | 0.0209 | 11.8 | 46.4 | 91.5 | 7.3 | 14.3 |
| Em 2 | 9.8 | 0.3 | 4.9 | 0.0160 | 11.3 | 49.4 | 87.7 | 10.1 | 17.9 |
| Em 3 | 9.8 | 0.3 | 4.5 | 0.0147 | 8.5 | 39.8 | 93.5 | 8.8 | 20.8 |
| Em 4 | 9.8 | 0.3 | 7.2 | 0.0235 | 18.8 | 40.9 | 113.2 | 5.7 | 15.7 |
| Em 5 | 9.8 | 0.3 | 5.3 | 0.0173 | 10.7 | 52.7 | 84.3 | 9.9 | 15.9 |
| Em 6 | 9.8 | 0.3 | 4.1 | 0.0134 | 9.1 | 34.8 | 86.1 | 8.5 | 21 |
| Em 7 | 9.8 | 0.3 | 4.5 | 0.0147 | 11.2 | 56.6 | 103.6 | 12.6 | 23 |
| Em 8 | 9.8 | 0.3 | 5.9 | 0.0193 | 16.3 | 59.9 | 117.1 | 10.2 | 19.8 |
| Em 9 | 9.8 | 0.3 | 8.2 | 0.0268 | 20.5 | 69.8 | 118.5 | 8.5 | 14.5 |
| Em 10 | 9.8 | 0.3 | 7.6 | 0.0248 | 19.5 | 61.9 | 107.7 | 8.1 | 14.2 |
| Em 11 | 9.8 | 0.3 | 4.3 | 0.0140 | 10.3 | 47.2 | 74.3 | 10.9 | 17.2 |
| Em 12 | 9.8 | 0.3 | 67.6 | 0.2208 | 287 | 859 | 1642 | 12.7 | 24.3 |
| Em 13 | 9.8 | 0.3 | 108 | 0.3538 | 457 | 1089 | 2534 | 10.1 | 23.3 |
| Em 14 | 9.8 | 0.3 | 3.9 | 0.0127 | 15.3 | 67.9 | 88.6 | 17.4 | 22.7 |
| Comp 1 | 9.8 | 0.3 | 2.4 | 0.0078 | 14.3 | 97.2 | 174 | 40.5 | 72.6 |
| Comp 2 | 9.8 | 0.3 | 5.8 | 0.0189 | 15.4 | 74.2 | 168 | 12.8 | 29.1 |
| Comp 3 | 9.8 | 0.3 | 4.6 | 0.0150 | 12.4 | 82.8 | 124 | 18.0 | 27.1 |
| Comp 4 | 9.8 | 0.3 | 3.8 | 0.0124 | 9.6 | 54.2 | 116 | 14.3 | 30.6 |

The devices are subjected to trip jump test that is performed at a voltage of 6V and a current of 50 mA. The results are shown in Table 2. R10, R100 and R300 indicate the resistances of PTC material layer after tripping 10 times, 100 times and 300 times, respectively. The resistances after 100 times trip and 300 times trip are used for evaluating the trip jump behavior for this application. The ratios R100/Ri and R300/Ri are indexes showing the trip jump characteristic, where Ri is the initial resistance. The ratios of R300/Ri are less than 25 for all Em. 1 to Em. 14. Except Em. 3, Em 6-7 and Em. 12-14, R300/Ri are less than 20. For Em. 1 to Em. 14, R100/Ri are less than 18, and most of them are less than 15, or 12 in particular. For Comp. 1 to Comp. 4, R300/Ri are larger than 27. It can be appreciated that the stack of conductive ceramic filler of HCP structure can form more conductive paths thereby increasing conductivity and improving trip jump performance.

For Comp. 1-4, titanium carbide and zirconium carbide are of FCC stack structure, their trip jump performances are clearly worse than those of the embodiments using molybdenum carbide or tungsten carbide of HCP stack structure. Molybdenum carbide has a resistivity of around 97 μΩ-cm, a density of around 9.16 g/$cm^3$, and Vickers hardness of 1800 HV50. Tungsten carbide has a resistivity of around 80 μΩ-cm, a density of 15.63 g/$cm^3$ and a Vickers hardness of 2200HV50. Molybdenum carbide has lower conductivity, density and hardness. Compared to tungsten carbide, molybdenum carbide is suitable for lightweight design and is easily machined. Em. 9 and Em. 10 use both tungsten carbide and molybdenum carbide as conductive ceramic filler. Although their resistivity values are not the lowest one among all embodiments, R300/Ri≦15 and R100/Ri≦10 show superior trip jump performance. In practice, the weight ratio of molybdenum carbide to tungsten carbide is between 0.5-1.5, or 0.8-1.2 in particular.

It can be noted from Table 2 that the over-current protection device including crystalline polymer with conductive ceramic filler of specific structure dispersed therein can obtain a low initial resistance. Except Em. 12 and Em. 13, Ri values are smaller than 10 mΩ). Moreover, as mentioned above, the over-current protection device is expected to exhibit good trip jump behavior.

The above-described embodiments of the present invention are intended to be illustrative only. Numerous alternative embodiments may be devised by persons skilled in the art without departing from the scope of the following claims.

We claim:

1. An over-current protection device, comprising:

two metal foils; and a PTC material layer laminated between the two metal foils, the PTC material layer having a resistivity less than 0.4 Ω-cm and comprising crystalline polymer and conductive ceramic filler dispersed in the crystalline polymer, wherein the conductive ceramic filler is of HCP structure and comprises 70%-95% by weight of the PTC material layer;

wherein a trip jump value R300/Ri is less than or equal to 25, where R300 is a resistance of the PTC material layer after tripping 300 times and Ri is an initial resistance of the PTC material layer.

2. The over-current protection device of claim 1, wherein the conductive ceramic filler comprises molybdenum carbide, tungsten carbide or the mixture thereof.

3. The over-current protection device of claim 1, wherein the PTC material layer further comprises magnetic material.

4. The over-current protection device of claim 3, wherein the magnetic material comprises iron, cobalt, nickel, vanadium or the mixture thereof.

5. The over-current protection device of claim 3, wherein the magnetic material comprises less than 15% by weight of the PTC material layer.

6. The over-current protection device of claim 1, wherein a trip jump value R100/Ri is less than 18, R100 indicates a resistance of the PTC material layer after tripping 100 times.

7. The over-current protection device of claim 1, wherein the conductive ceramic filler comprises tungsten carbide and molybdenum carbide, and R300/Ri is less than or equal to 15.

8. The over-current protection device of claim 7, wherein a trip jump value R100/Ri is less than or equal to 10, R100 is the resistance of the PTC material layer after tripping 100 times.

9. The over-current protection device of claim 7, wherein a weight ratio of the molybdenum carbide to the tungsten carbide is between 0.5 and 1.5.

10. The over-current protection device of claim 1, wherein the trip jump value is measured at a voltage of 6V and a current of 50 mA.

11. The over-current protection device of claim 1, wherein the PTC material layer has a thickness greater than 0.1 mm.

12. The over-current protection device of claim 1, wherein the PTC material layer has an initial resistance less than 10 mΩ.

13. The over-current protection device of claim 1, wherein the crystalline polymer comprises polyolefin.

14. The over-current protection device of claim 13, wherein the polyolefin comprises high-density polyethylene, medium-density polyethylene, low-density polyethylene, polyvinyl wax, vinyl polymer, polypropylene, polyvinyl chlorine and polyvinyl fluoride.

15. The over-current protection device of claim 1, wherein the conductive ceramic filler has a grain size of between 0.1 μm and 50 μm.

16. The over-current protection device of claim 1, wherein the PTC material layer has an area less than 50 $mm^2$.

17. The over-current protection device of claim 1, wherein the PTC material layer further comprises metal oxide, metal hydroxide or metal nitride.

18. The over-current protection device of claim 1, wherein PTC material layer has a resistivity less than 0.1 Ω-cm.

* * * * *